US011166618B2

(12) United States Patent
Thiyagarajan et al.

(10) Patent No.: US 11,166,618 B2
(45) Date of Patent: Nov. 9, 2021

(54) DRYING SYSTEM WITH HEAT PIPE AND THERMOELECTRIC ASSEMBLY

(71) Applicant: Haier US Appliance Solutions, Inc., Wilmington, DE (US)

(72) Inventors: Ramasamy Thiyagarajan, Louisville, KY (US); Adam Christopher Hofmann, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 117 days.

(21) Appl. No.: 16/124,302

(22) Filed: Sep. 7, 2018

(65) Prior Publication Data

US 2020/0077867 A1 Mar. 12, 2020

(51) Int. Cl.

| | |
|---|---|
| ***A47L 15/00*** | (2006.01) |
| ***A47L 15/42*** | (2006.01) |
| ***A47L 15/48*** | (2006.01) |
| ***F26B 3/20*** | (2006.01) |
| ***F28D 15/02*** | (2006.01) |

(52) U.S. Cl.

CPC ..... *A47L 15/4291* (2013.01); *A47L 15/0034* (2013.01); *A47L 15/483* (2013.01); *F26B 3/20* (2013.01); *F28D 15/0275* (2013.01); *A47L 2501/06* (2013.01); *A47L 2501/10* (2013.01); *A47L 2501/12* (2013.01)

(58) Field of Classification Search

CPC ..... A47L 15/0034; A47L 15/4291; A47L 15/483; A47L 2501/06; A47L 2501/10; A47L 2501/12; F26B 3/20; F28D 15/0275

USPC ..... 34/476; 134/56 D, 57 D, 58 D, 105, 107

See application file for complete search history.

(56) References Cited

U.S. PATENT DOCUMENTS

| | | | | |
|---|---|---|---|---|
| 8,603,260 | B2 | 12/2013 | Classen et al. | |
| 2012/0204911 | A1* | 8/2012 | Classen | A47L 15/483 134/105 |
| 2013/0333238 | A1 | 12/2013 | Thiyagarajan | |

FOREIGN PATENT DOCUMENTS

| | | | |
|---|---|---|---|
| EP | 2578741 | B1 | 4/2017 |

* cited by examiner

*Primary Examiner* — Levon J Shahinian
(74) *Attorney, Agent, or Firm* — Dority & Manning, P.A.

(57) ABSTRACT

A dishwashing appliance includes a tub defining a wash chamber. The tub includes an inlet and an outlet. The dishwashing appliance also includes a drying system in fluid communication with the wash chamber. The drying system includes a heat pipe heat exchanger having a condenser section and an evaporator section. The evaporator section is downstream of the outlet. The condenser section is downstream of the evaporator section and upstream of the inlet. A thermoelectric assembly is in thermal communication with the heat pipe heat exchanger.

20 Claims, 7 Drawing Sheets

DRYING SYSTEM WITH HEAT PIPE AND THERMOELECTRIC ASSEMBLY

FIELD

The present subject matter relates generally to a drying system, which may be used in washing appliances, such as dishwashing appliances.

BACKGROUND

Dishwashing appliances generally include a tub that defines a wash chamber. Rack assemblies can be mounted within the wash chamber for receipt of articles for washing. Various cycles may be included as part of the overall cleaning process. For example, a typical, user-selected cleaning option may include a wash cycle and rinse cycle (referred to collectively as a wet cycle), as well as a drying cycle. In addition, spray-arm assemblies within the wash chamber may be used to apply or direct fluid towards the articles disposed within the rack assemblies in order to clean such articles. As is generally understood, dishwashing appliances may often include multiple spray-arm assemblies, such as a lower spray-arm assembly mounted to the tub at a bottom of the wash chamber, a mid-level spray-arm assembly mounted to one of the rack assemblies, and/or an upper spray-arm assembly mounted to the tub at a top of the wash chamber.

Fluids used in the cleaning process may be heated. For example, hot water may be supplied to the dishwasher and/or the dishwasher may include one or more heat sources for heating fluids used in wash or rinse cycle and for providing heat during a drying cycle. It is common to provide dishwashers with rod-type, resistive heating elements in order to supply heat within the wash chamber during one or more of the dishwasher cycles (e.g., to heat air during the drying cycle). Generally, these heating elements include an electric resistance-type wire that is encased in a ceramic-filled, metallic sheath. A significant portion of the energy used to heat the dishwasher, e.g., for the wash cycle, may be wasted when the hot air is discharged from the dishwasher during the drying cycle.

Accordingly, an improved dehumidification device for an appliance that provides for energy recovery during drying would be welcomed.

BRIEF DESCRIPTION

Aspects and advantages of the invention will be set forth in part in the following description, or may be obvious from the description, or may be learned through practice of the invention.

In one aspect, the present subject matter is directed to a dishwashing appliance. The dishwashing appliance includes a tub defining a wash chamber. The tub includes an inlet and an outlet. The dishwashing appliance also includes a drying system in fluid communication with the wash chamber. The drying system includes a heat pipe heat exchanger having a condenser section and an evaporator section. The evaporator section is downstream of the outlet. The condenser section is downstream of the evaporator section and upstream of the inlet. A thermoelectric assembly is in thermal communication with the heat pipe heat exchanger.

In another aspect, the present subject matter is directed to a drying system. The drying system includes a heat pipe heat exchanger having a condenser section and an evaporator section. The heat pipe heat exchanger is in fluid communication with a wet chamber defined within a tub. The evaporator section is downstream of an outlet of the tub. The condenser section is downstream of the evaporator section and upstream of an inlet of the tub. The drying system also includes a thermoelectric assembly in thermal communication with the heat pipe heat exchanger.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
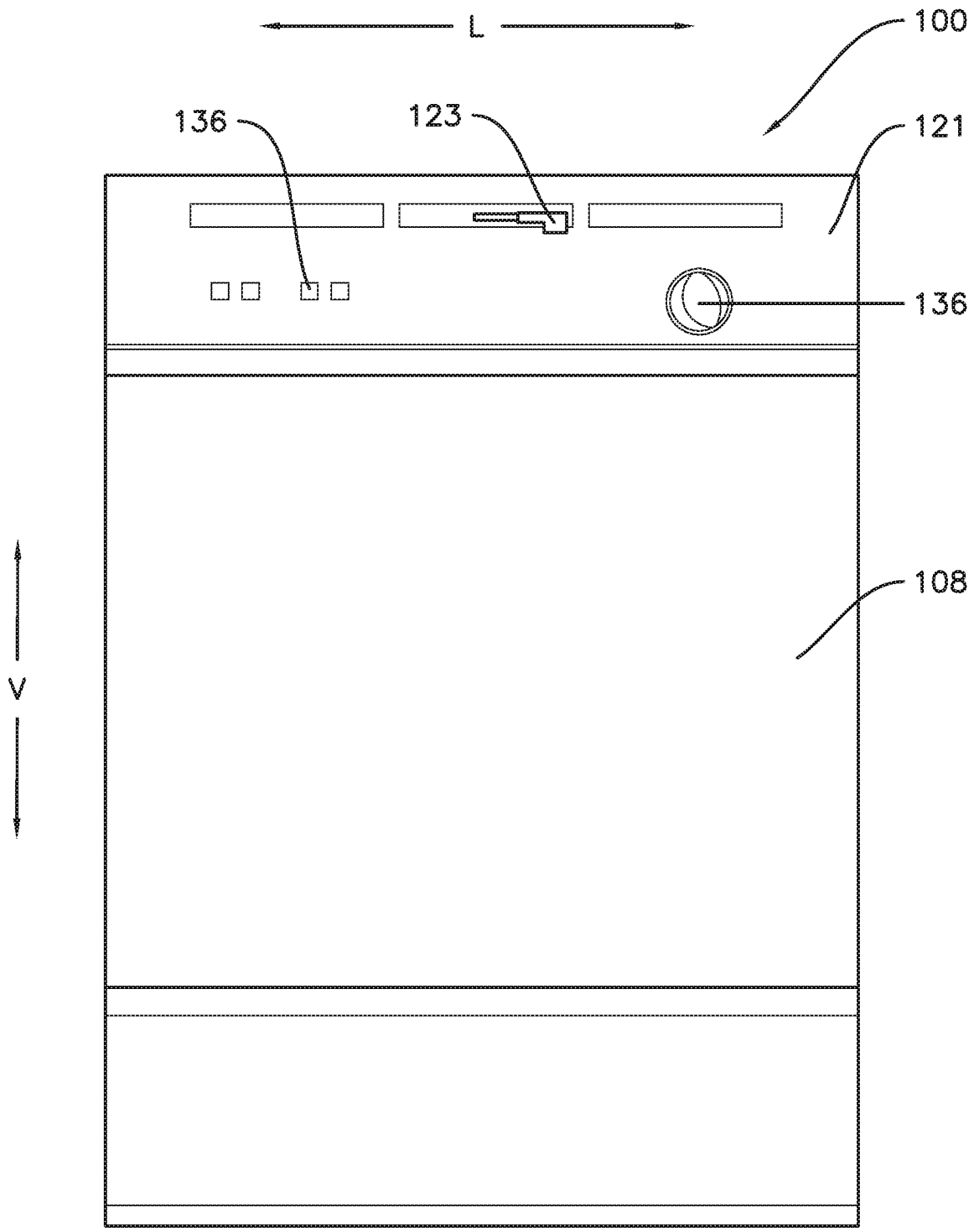
FIG. 1 illustrates a front view of one embodiment of a dishwashing appliance in accordance with aspects of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows. As used herein, terms of approximation such as "generally," "about," or "approximately" include values within ten percent greater or less than the stated value. When used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

Figure 2:
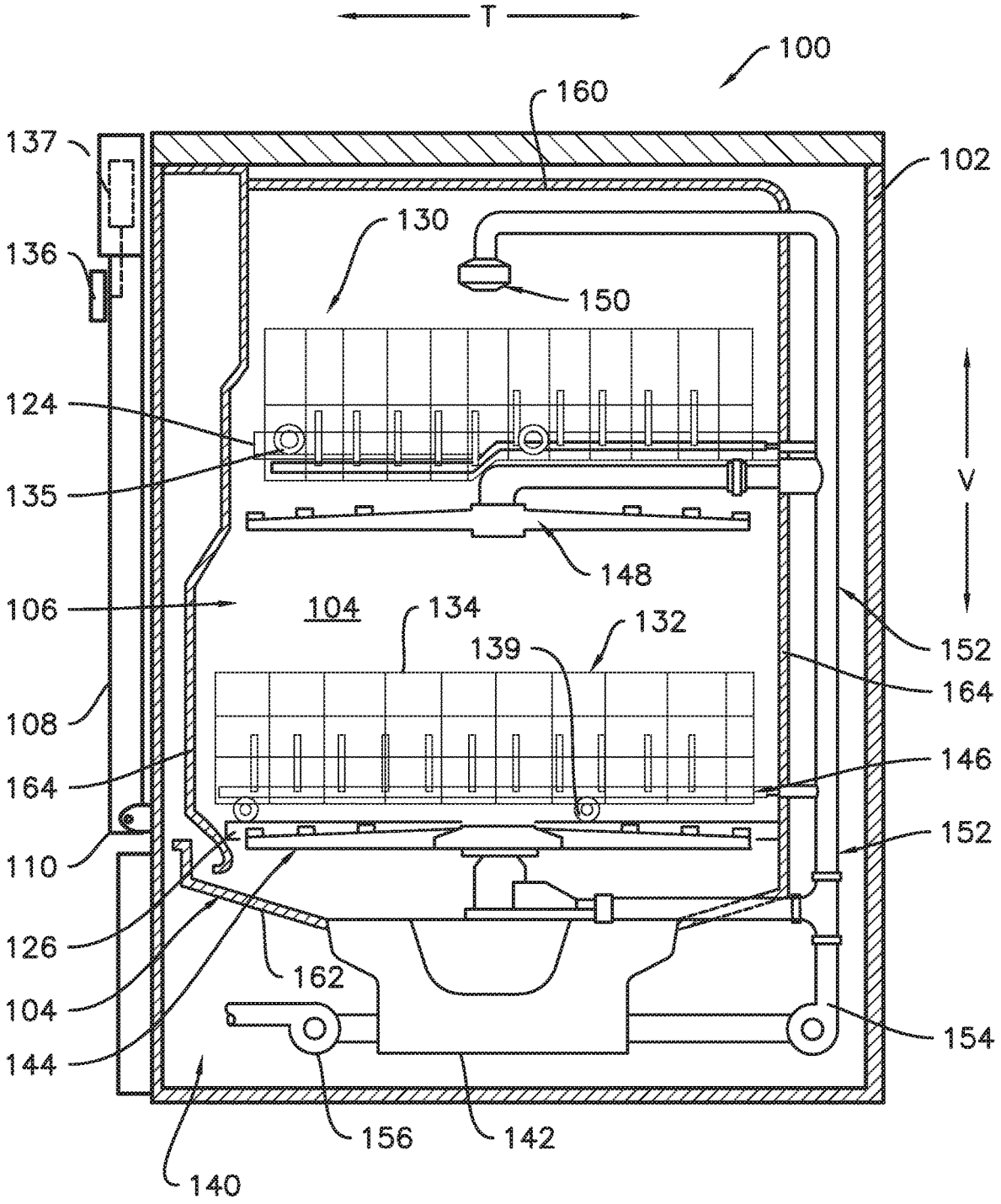
FIG. 2 illustrates a cross-sectional side view of the dishwashing appliance shown in FIG. 1, particularly illustrating various internal components of the dishwashing appliance.

Referring now to the drawings, FIGS. 1 and 2 illustrate one embodiment of a domestic dishwashing appliance 100 that may be configured in accordance with aspects of the present disclosure. As shown in FIGS. 1 and 2, the dishwashing appliance 100 may include a cabinet 102 having a tub 104 therein defining a wash chamber 106. The tub 104 may generally include a front opening (not shown) and a door 108 hinged at its bottom 110 for movement between a normally closed vertical position (shown in FIGS. 1 and 2), wherein the wash chamber 106 is sealed shut for washing operation, and a horizontal open position for loading and unloading of articles from the dishwasher. As shown in FIG. 1, a latch 123 may be used to lock and unlock the door 108 for access to the chamber 106.

As is understood, the tub 104 may generally have a rectangular cross-section defined by various wall panels or walls. For example, as shown in FIG. 2, the tub 104 may include a top wall 160 and a bottom wall 162 spaced apart from one another along a vertical direction V of the dishwashing appliance 100. Additionally, the tub 104 may include a plurality of sidewalls 164 (e.g., four sidewalls) extending between the top and bottom walls 160, 162. It should be appreciated that the tub 104 may generally be formed from any suitable material. However, in several embodiments, the tub 104 may be formed from a ferritic material, such as stainless steel, or a polymeric material.

As particularly shown in FIG. 2, upper and lower guide rails 124, 126 may be mounted on opposing side walls 164 of the tub 104 and may be configured to accommodate roller-equipped rack assemblies 130 and 132. Each of the rack assemblies 130, 132 may be fabricated into lattice structures including a plurality of elongated members 134 (for clarity of illustration, not all elongated members making up assemblies 130 and 132 are shown in FIG. 2). Additionally, each rack 130, 132 may be adapted for movement along a transverse direction T between an extended loading position (not shown) in which the rack is substantially positioned outside the wash chamber 106, and a retracted position (shown in FIGS. 1 and 2) in which the rack is located inside the wash chamber 106. This may be facilitated by rollers 135 and 139, for example, mounted onto racks 130 and 132, respectively. As is generally understood, a silverware basket (not shown) may be removably attached to rack assembly 132 for placement of silverware, utensils, and the like, that are otherwise too small to be accommodated by the racks 130, 132.

Additionally, the dishwashing appliance 100 may also include a lower spray-arm assembly 144 that is configured to be rotatably mounted within a lower region 146 of the wash chamber 106 directly above the bottom wall 162 of the tub 104 so as to rotate in relatively close proximity to the rack assembly 132. As shown in FIG. 2, a mid-level spray-arm assembly 148 may be located in an upper region of the wash chamber 106, such as by being located in close proximity to the upper rack 130. Moreover, an upper spray assembly 150 may be located above the upper rack 130.

As is generally understood, the lower and mid-level spray-arm assemblies 144, 148 and the upper spray assembly 150 may generally form part of a fluid circulation system 152 for circulating fluid (e.g., water and dishwasher fluid which may also include water, detergent, and/or other additives, and may be referred to as wash liquor) within the tub 104. As shown in FIG. 2, the fluid circulation system 152 may also include a recirculation pump 154 located in a machinery compartment 140 below the bottom wall 162 of the tub 104, as is generally recognized in the art, and one or more fluid conduits for circulating the fluid delivered from the pump 154 to and/or throughout the wash chamber 106. The tub 104 may include a sump 142 positioned at a bottom of the wash chamber 106 for receiving fluid from the wash chamber 106. The recirculation pump 154 receives fluid from sump 142 to provide a flow to fluid circulation system 152, which may include a switching valve or diverter (not shown) to select flow to one or more of the lower and mid-level spray-arm assemblies 144, 148 and the upper spray assembly 150.

Moreover, each spray-arm assembly 144, 148 may include an arrangement of discharge ports or orifices for directing washing liquid onto dishes or other articles located in rack assemblies 130 and 132, which may provide a rotational force by virtue of washing fluid flowing through the discharge ports. The resultant rotation of the lower spray-arm assembly 144 provides coverage of dishes and other dishwasher contents with a washing spray.

A drain pump 156 may also be provided in the machinery compartment 140 and in fluid communication with the sump 142. The drain pump 156 may be in fluid communication with an external drain (not shown) to discharge fluid, e.g., used wash liquid, from the sump 142.

The dishwashing appliance 100 may be further equipped with a controller 137 configured to regulate operation of the dishwasher 100. The controller 137 may generally include one or more memory devices and one or more microprocessors, such as one or more general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 137 may be positioned in a variety of locations throughout dishwashing appliance 100. In the illustrated embodiment, the controller 137 is located within a control panel area 121 of the door 108, as shown in FIG. 1. In such an embodiment, input/output ("I/O") signals may be routed between the control system and various operational components of the dishwashing appliance 100 along wiring harnesses that may be routed through the bottom of the door 108. Typically, the controller 137 includes a user interface panel/controls 136 through which a user may select various operational features and modes and monitor progress of the dishwasher 100. In one embodiment, the user interface 136 may represent a general purpose I/O ("GPIO") device or functional block. Additionally, the user interface 136 may include input components, such as one or more of a variety of electrical, mechanical or electro-mechanical input devices including rotary dials, push buttons, and touch pads. The user interface 136 may also include a display component, such as a digital or analog display device designed to provide operational feedback to a user. As is generally understood, the user interface 136 may be in communication with the controller 137 via one or more signal lines or shared communication busses. It should be noted that controllers 137 as disclosed herein are capable of and may be operable to perform any methods and associated method steps as disclosed herein.

It should be appreciated that the present subject matter is not limited to any particular style, model, or configuration of dishwashing appliance. The exemplary embodiment depicted in FIGS. 1 and 2 is simply provided for illustrative purposes only. For example, different locations may be provided for the user interface 136, different configurations may be provided for the racks 130, 132, and other differences may be applied as well.

Figure 3:
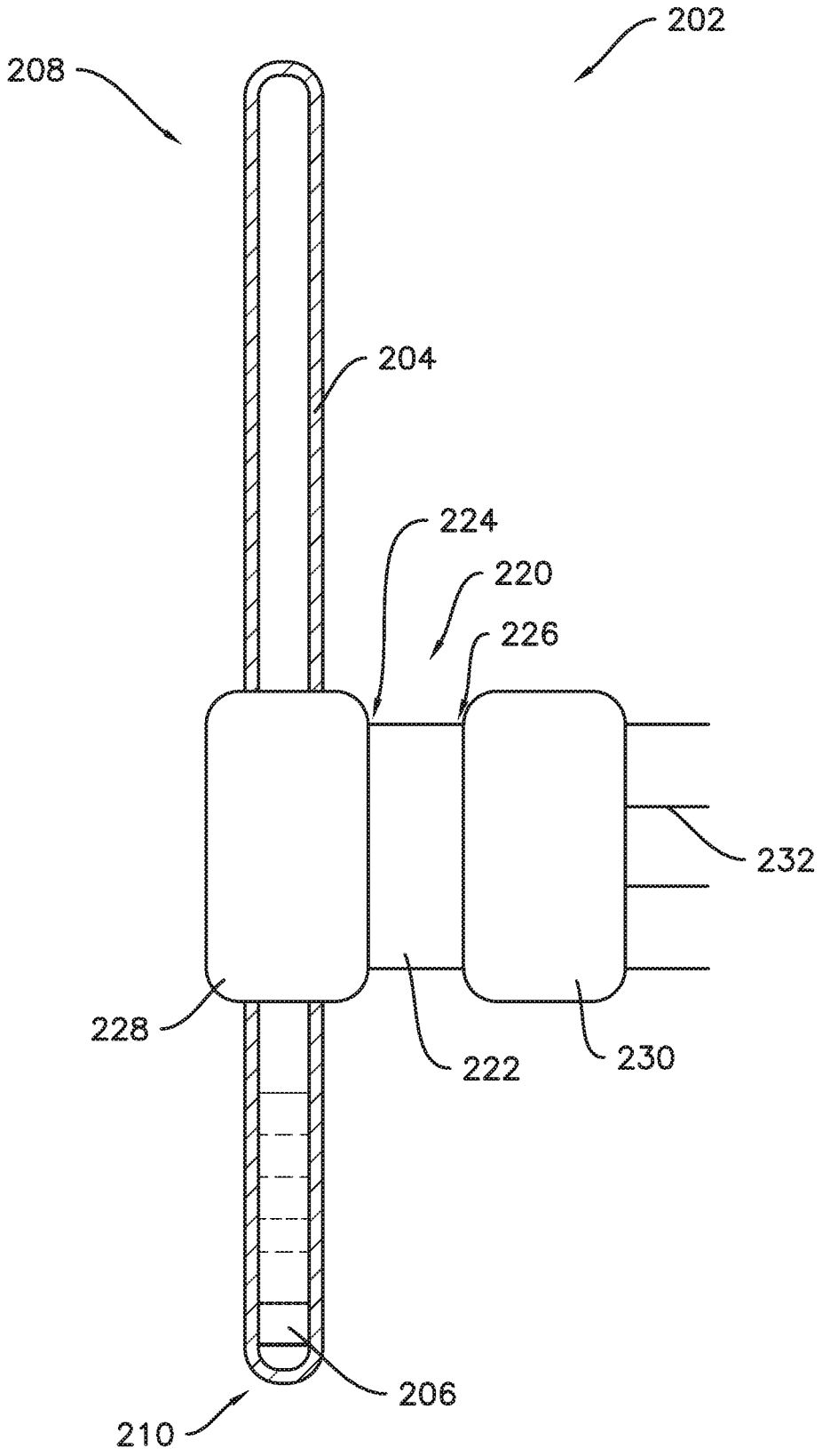
FIG. 3 illustrates components which may form part of an exemplary drying system according to one or more embodiments of the present disclosure.

An exemplary heat pipe heat exchanger 202, sometimes referred to herein as a "heat pipe," is illustrated in FIG. 3 which may be incorporated into an appliance such as the dishwashing appliance 100, and in particular may be used in a drying system 200 (FIGS. 4 through 7) for an appliance. As illustrated in FIG. 3, the heat pipe 202 includes a sealed casing 204 containing a working fluid 206 in the casing 204. The casing 204 is preferably constructed of a material with a high thermal conductivity, such as a metal, such as copper or aluminum. In some embodiments, the working fluid 206 may be water. In other embodiments, suitable working fluids for the heat pipe 202 include acetone, methanol, ethanol, or toluene. Any suitable fluid may be used for working fluid 206, e.g., any fluid that is compatible with the material of the casing 204 and is suitable for the desired operating temperature range. The heat pipe 202 extends between a condenser section 208 and an evaporator section 210. The working fluid 206 contained within the casing 204 of the heat pipe 202 absorbs thermal energy at the evaporator section 210, whereupon the working fluid 206 travels in a gaseous state from the evaporator section 210 to the condenser section 208. At the condenser section 208, the gaseous working fluid 206 condenses to a liquid state and thereby releases thermal energy. In particular embodiments, a flow of air may be provided to one or both of the condenser section 208 and the evaporator section 210. The drying system 200 may be configured such that the air will flow around the corresponding condenser section 208 and/or evaporator section 10, thus providing thermal transfer between the flow of air and the heat pipe 202, particularly the working fluid 206 (which is in vapor form at the condenser section 208 and is in liquid form at the evaporator section 210) of the heat pipe 202.

The heat pipe 202 may include an internal wick structure (not shown) to transport liquid working fluid 206 from the condenser section 208 to the evaporator section 210 by capillary flow. In some embodiments, the heat pipe 202 may be constructed and arranged such that the liquid working fluid 206 returns to the evaporator section 210 solely by gravity flow. For example, the dishwasher appliance 100 may be constructed such that the heat pipe 202 may be arranged along the vertical direction V with the condenser section 208 positioned above the evaporator section 210 such that condensed working fluid 206 in a liquid state may flow from the condenser section 208 to the evaporator section 210 by gravity. In such embodiments, where the liquid working fluid 206 may return to the evaporator section 210 by gravity, the wick structure may be omitted.

Also illustrated in FIG. 3 is a thermoelectric assembly 220 which may be in thermal communication with the heat pipe 202 in some embodiments. As shown in FIG. 3, the thermoelectric assembly 220 may include a thermoelectric converter 222 having a hot side 224 and a cold side 226. In general, a thermo-electric converter 222 converts electrical energy to heat. Thus, electricity, e.g., from a 12/24 DC power supply, may be supplied to activate the thermo-electric converter 222 and the thermo-electric converter 222 may be operable to generate heat when the electric power is provided. Thermoelectric converter 222 generally includes anodes, cathodes, and other components suitable for converting electrical energy to heat. The structure and function of such thermoelectric converters are generally understood in the art and, as such, will not be described in further detail herein for the sake of clarity and brevity.

The thermoelectric assembly 220 may further include a hot plate 228 connected to the hot side 224 of the thermoelectric converter 222 and a cold plate 230 connected to the cold side 226 of the thermoelectric converter 222. In some embodiments, a plurality of fins 232 may be provided on the cold plate 230 of the thermoelectric assembly 220, to provide increased surface area for contact with a flow of air, as will be described in more detail below.

As shown in FIG. 3, the thermoelectric assembly 220, e.g., the hot plate 228 thereof, may be in thermal communication with the heat pipe 202. In particular embodiments, the thermoelectric assembly 220 may be in thermal communication with the evaporator section 210 of the heat pipe 202. For example, the hot plate 230 may be in direct contact with, e.g., integrally connected to, the heat pipe 202 at or proximate to the evaporator section 210, as shown in FIG. 3. In other embodiments, e.g., as shown in FIG. 7, the hot plate 228 may be closely spaced from the heat pipe 202, e.g., proximate to the heat pipe 202, whereby the hot plate 228 is sufficiently close to the heat pipe 202 to transfer thermal energy to, e.g., heat up, the heat pipe 202. Accordingly, the heat pipe 202 may transfer heat from the thermoelectric assembly 220 to a flow of air 12, as shown in FIGS. 4 through 7 and described below. In some embodiments, only the hot side 224 of the thermoelectric converter 222 may be in direct thermal communication with the heat pipe 202, whereas the cold side 226 of the thermoelectric converter 222 may be in indirect thermal communication with the heat pipe 202 via one or more air flows.

Figure 4:
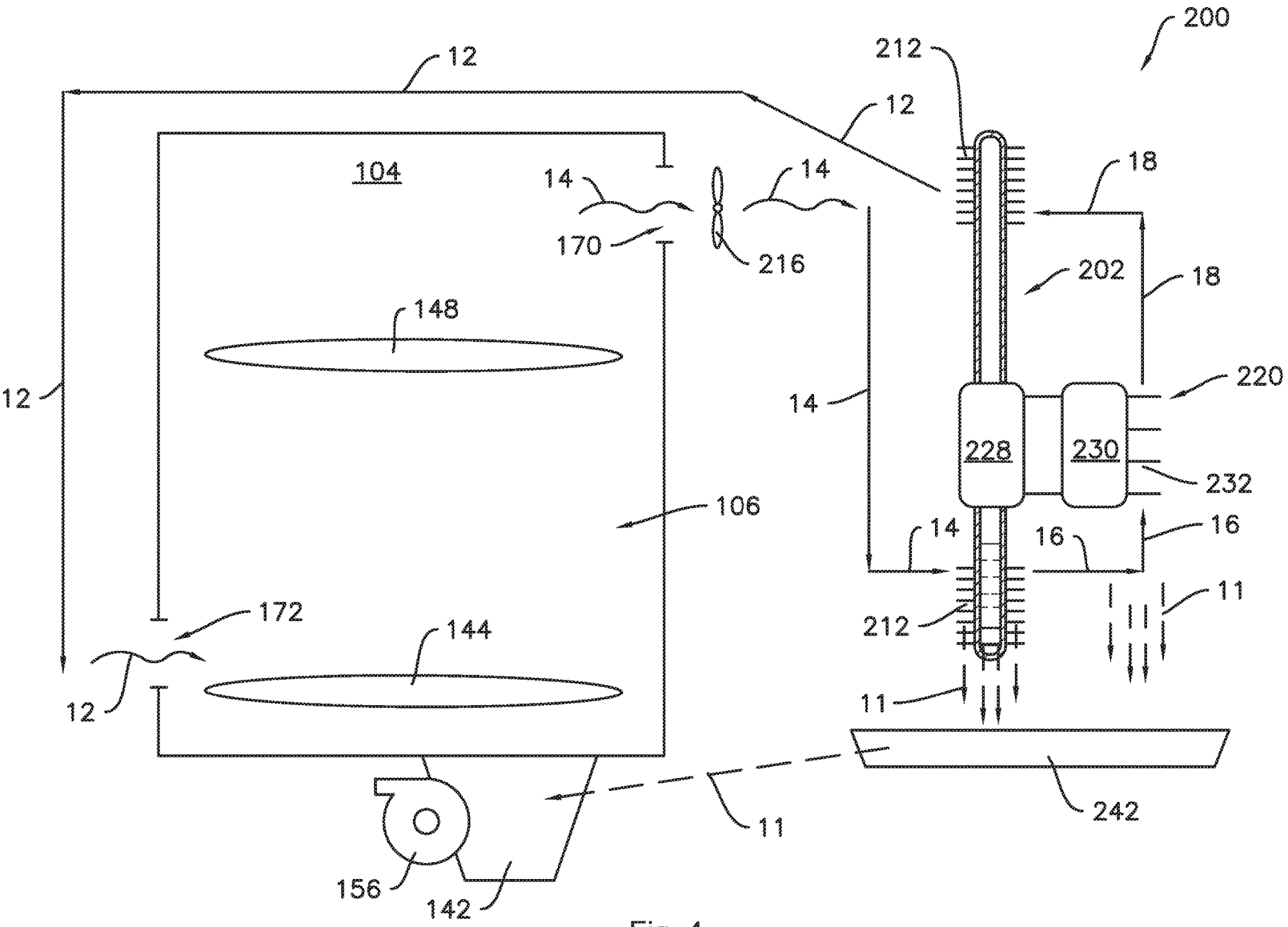
FIG. 4 illustrates a schematic view of a drying system for a dishwashing appliance according to one or more embodiments of the present disclosure.

Referring now to FIG. 4, an exemplary dishwashing appliance 100 including a drying system 200 according to one or more embodiments of the present disclosure is illustrated. In various embodiments of the present disclosure, the drying system 200 may be in fluid communication with a wet chamber in order to promote drying of the chamber itself and/or of wet articles therein. For example, the wet chamber may be part of a clothes washing appliance or other similar appliance. As another example, the wet chamber may be the wash chamber of a dishwashing appliance, such as the wash chamber 106 described above, and wet articles, e.g., dishes, may be located therein. As illustrated in FIG. 4, the tub 104 may include an outlet 170 through which exhaust air 14 may flow from the wash chamber 106 to the drying system 200. It should be understood that the wash chamber 106 is but one example of a possible wet chamber with which a drying system according to the present disclosure may be used. Accordingly, the condenser section 208 may be in fluid communication with the wet chamber, e.g., wash chamber 106, via the inlet 172 and the evaporator section 210 may be in fluid communication with the wet chamber, e.g., wash chamber 106, via the outlet 170. For example, as illustrated in FIG. 4, the condenser section 208 may be in fluid communication with the wash chamber 106 downstream of the outlet 170 and the evaporator section 210 may be downstream of the condenser section 210 and upstream of the inlet 172. Further, the cold plate 230 of the thermoelectric assembly 220 may be in fluid communication with the heat pipe 202 upstream of the evaporator section 210 and downstream of the condenser section 208. As noted above, "downstream" means, e.g., the evaporator section 210 may be downstream of the wash chamber 106 with respect to the flow direction of air flowing from the wash chamber 106 via the outlet 170 to the drying system, and "upstream" means, e.g., the condenser section 208 may be upstream of the wash chamber 106 with respect to the flow direction of air flowing from the drying system 200 into the wash chamber 106 via the inlet 172, and similar meanings are intended with respect to air flowing within the drying system 200, e.g., from the evaporator section 210 to the cold plate 230, such that the cold plate 230 is downstream of the evaporator section 210, as indicated by arrows 12, 14, 16, and 18.

Also as shown in FIG. 4, a plurality of fins 212 may be provided on an external surface of the casing 204 of the heat pipe 202 at each of the condenser section 208 and the evaporator section 210. The fins 212 may provide an increased contact area between the heat pipe 202 and air flowing around the heat pipe 202 for improved transfer of thermal energy.

As used herein, "warm air" includes air having a temperature higher than an ambient temperature, and "hot air" includes air having a temperature higher than the warm air. For example, the ambient temperature may range from about 65° F. to about 85° F. Accordingly, "warm air" may be at least about 90° F., up to about 130° F., such as about 120° F. Further "hot air" may include air temperatures of about 145° F. or more, such as between about 145° F. and about 215° F., such as between about 160° F. and about 190° F., such as between about 150° F. and about 170° F. As used herein, terms of approximation, such as "generally," or "about" include values within ten percent greater or less than the stated value. For example, "about 160° F." includes from 144° F. to 176° F. As used herein, "dry air" includes air having a relative humidity of about thirty percent or less, such as less than about twenty percent, such as less than about ten percent, such as less than about five percent. As used herein, "humid air" includes air having a relative humidity greater than about eighty percent, such as greater than about ninety percent, such as about one hundred percent.

As illustrated for example in FIG. 4, an exhaust fan 216 may be provided proximate the outlet 170 and upstream of the evaporator section 210. Thus, hot, humid exhaust air 14 may pass through outlet 170, e.g., the hot, humid air 14 may be urged from the wash chamber 106 through the outlet 170 by exhaust fan 216, such that the hot, humid air 14 passes over and around the evaporator section 210. The evaporator section 210 of the heat pipe 202 may absorb thermal energy from the hot, humid exhaust air 14, whereupon gaseous working fluid 206 travels within the heat pipe 202 to the condenser section 208 and a flow of warm, humid air 16 external to the heat pipe 202 may flow from the evaporator section 210. The flow of warm, humid air 16 may then be directed to or towards the thermoelectric assembly 220, such as to the cold plate 230 thereof, such as towards, across, and/or between one or more fins 232 formed on the cold plate 230. Accordingly, a flow of humid air 18 which is at or about an ambient temperature may be provided from the thermoelectric assembly 220 to the condenser section 206. The flow of ambient temperature air 18 to the condenser section 208 may activate the heat pipe 202, whereby the working fluid 206 may condense in the condenser section 208 and thereby impart thermal energy to the air such that a flow of hot, dry air 12 is formed, which may then be provided to the wash chamber 106, e.g., directed or channeled through one or more ducts, conduits, or plenum spaces within the cabinet 102 (FIG. 2) from the condenser section 208 to the inlet 172 of the tub 104.

The hot, humid exhaust air 14 may be directed, e.g., via a conduit or duct, from the outlet 170 to the evaporator section 210 of the heat pipe 202. For example, in some embodiments, the evaporator section 210 of the heat pipe 202 may be in direct fluid communication with the outlet 170 such that the exhaust air 14 flows to and across (e.g., over and around) the evaporator section 210 of the heat pipe 202. As shown, the heat pipe 202 includes fins 212 at the evaporator section 210 and the condenser section 208. Thus, the hot, humid exhaust air 14 may flow across the evaporator section 210 of the heat pipe 202, including, in some embodiments, fins 212 thereon, whereupon thermal energy from the hot, humid exhaust air 14 is absorbed by the working fluid 206 within the heat pipe 202, and moisture in the hot, humid exhaust air 14 is released as condensation 11. The condensation 11 may be drained, e.g., to sump 142. In some embodiments, the drying system 200 may include a condensation pan 242 which is connected to the sump 242 such that condensation 11 may flow from the condensation pan 242 to the sump 142. Thus, the flow of air 16, which is at a lower temperature than the hot, humid exhaust air 14, as described above, is provided to the cold plate 230 of the thermoelectric assembly 220. The flow of warm, humid air 16 will contain less moisture than the hot, humid exhaust air 14, yet, due to the reduced temperature of the warm, humid air 16, the warm, humid air 16 may also be humid air in that the relative humidity of the warm, humid air 16 may be generally the same as the relative humidity of the hot, humid exhaust air 14. As the warm, humid air 16 flows across the cold plate 230, the air is cooled and additional moisture is released from the air, e.g., additional condensation 11 is formed. Subsequently, a flow of ambient temperature humid air 18 may be provided from the cold plate 230 of the thermoelectric assembly 220 to the condenser section 208 of the heat pipe 202. Similar to the warm, humid air 16 with respect to the hot, humid exhaust air 14, the ambient temperature humid air 18 may be cooler than the warm, humid air 16 with about the same relative humidity.

As shown in FIG. 4, condensation 11 may be formed, e.g., released from the air, at multiple stages of the drying system 200, e.g., when the air temperature is lowered at the evaporator section 210 of the heat pipe and when the air temperature drops again at the cold plate 230 of the thermoelectric assembly 220, thereby lowering the moisture content at each stage, while the temperature is also lowered, such that the relative humidity generally remains about the same. Thus, the drying system 200 may be configured to drain condensation 11 from the evaporator section 210 of the heat pipe heat exchanger 202 and the cold plate 230 of the thermoelectric assembly 220 to the sump 142. For example, the condensation 11 from the evaporator section 210 and the cold plate 230 may be collected in the condensation pan 242 of the drying system 200 and then drained to the sump 142. Further, the condensation 11 may flow from the evaporator section 210 and the cold plate 230 by gravity, similarly to the condensed working fluid 206 in a liquid state which may flow within the heat pipe 202 from the condenser section 208 to the evaporator section 210 by gravity, as mentioned above.

The heat pipe 202 may generally provide heat transfer from the exhaust air 14 and the hot plate 228 of the thermoelectric assembly 220 to a flow of ambient temperature air 18, and the resulting flow of hot, dry air 12 may be returned to the wash chamber 106. Thus, heat from the exhaust air 14 which would otherwise be wasted to the ambient environment may be captured by the drying system 200 and used to promote drying of articles, e.g., dishes, in the wash chamber 106.

In some embodiments, e.g., as illustrated in FIG. 4, the drying system 200 may be a closed loop drying system fluidly isolated from an ambient environment around the dishwasher appliance 100. In such embodiments, the condenser section 208 of the heat pipe 202 will only receive the flow of air 18 directly from the cold plate 230 of the thermoelectric assembly 220. In other embodiments, e.g., as shown in FIGS. 5 and 6 and described below, the condenser section 208 of the heat pipe 202 may receive a mixed flow of air, e.g., one or more additional sources of air may be provided as well as the ambient temperature humid air 18 from the cold plate 230.

Figure 5:
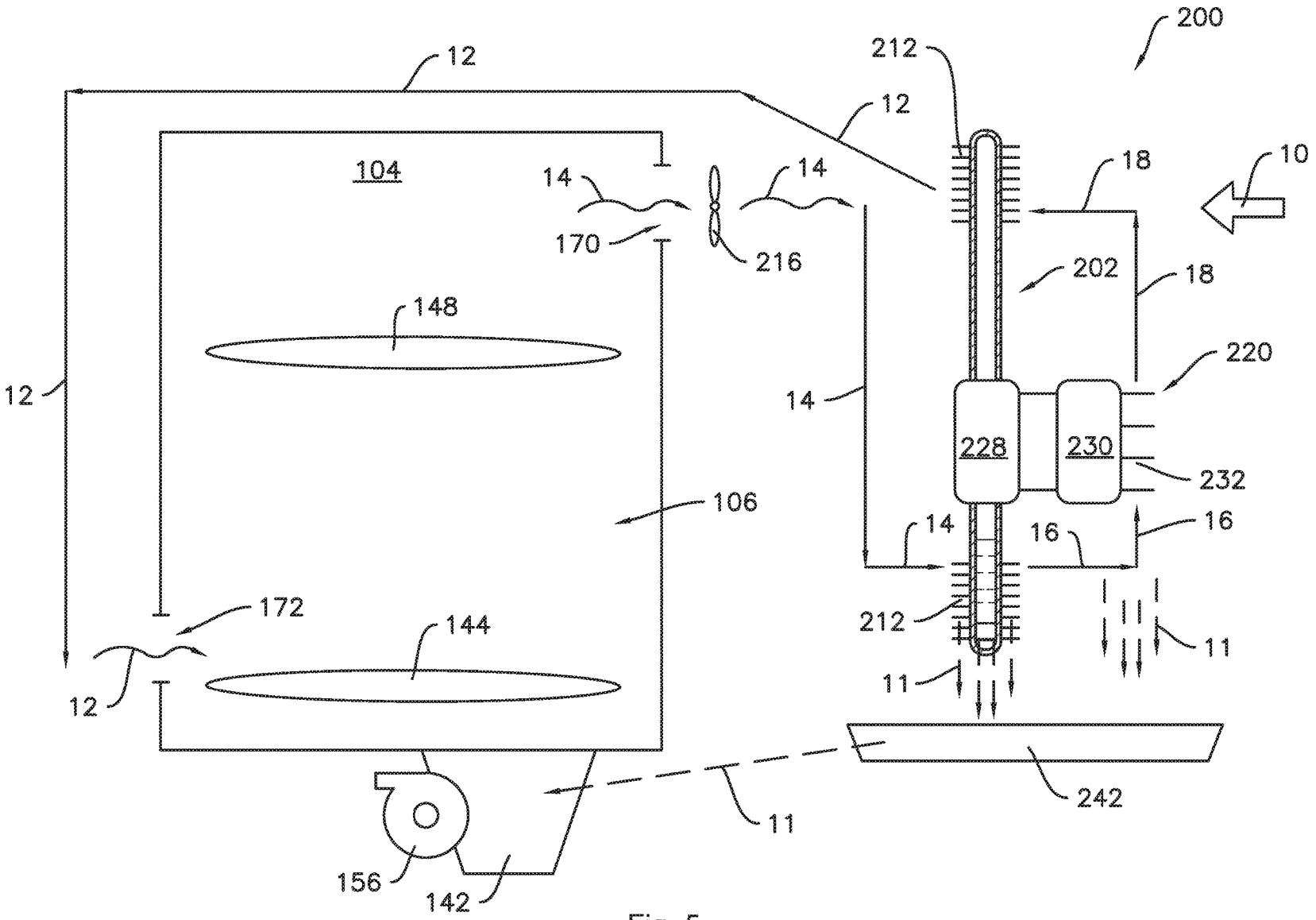
FIG. 5 illustrates a schematic view of a drying system for a dishwashing appliance according to one or more additional embodiments of the present disclosure.

For example, as illustrated in FIG. 5, the drying system 200 may be an open loop drying system in fluid communication with the ambient environment around the dishwashing appliance 100. As such, ambient air 10 may flow from the ambient environment, through the drying system 200 and then to the wash chamber 106 within tub 104. As used herein, the ambient environment refers to the area externally around the dishwashing appliance 100, e.g., the ambient environment in close proximity to an exterior of the dishwashing appliance 100, such as the immediate surroundings of the dishwashing appliance 100 from which air may be drawn directly into the cabinet 102 (FIG. 2). Thus, in some embodiments, the condenser section 208 may receive a flow of mixed air containing both ambient temperature humid air 18 and ambient air 17, where the ambient air 17 may generally be dry air and/or have a relative humidity less than the ambient temperature humid air 18.

Figure 6:
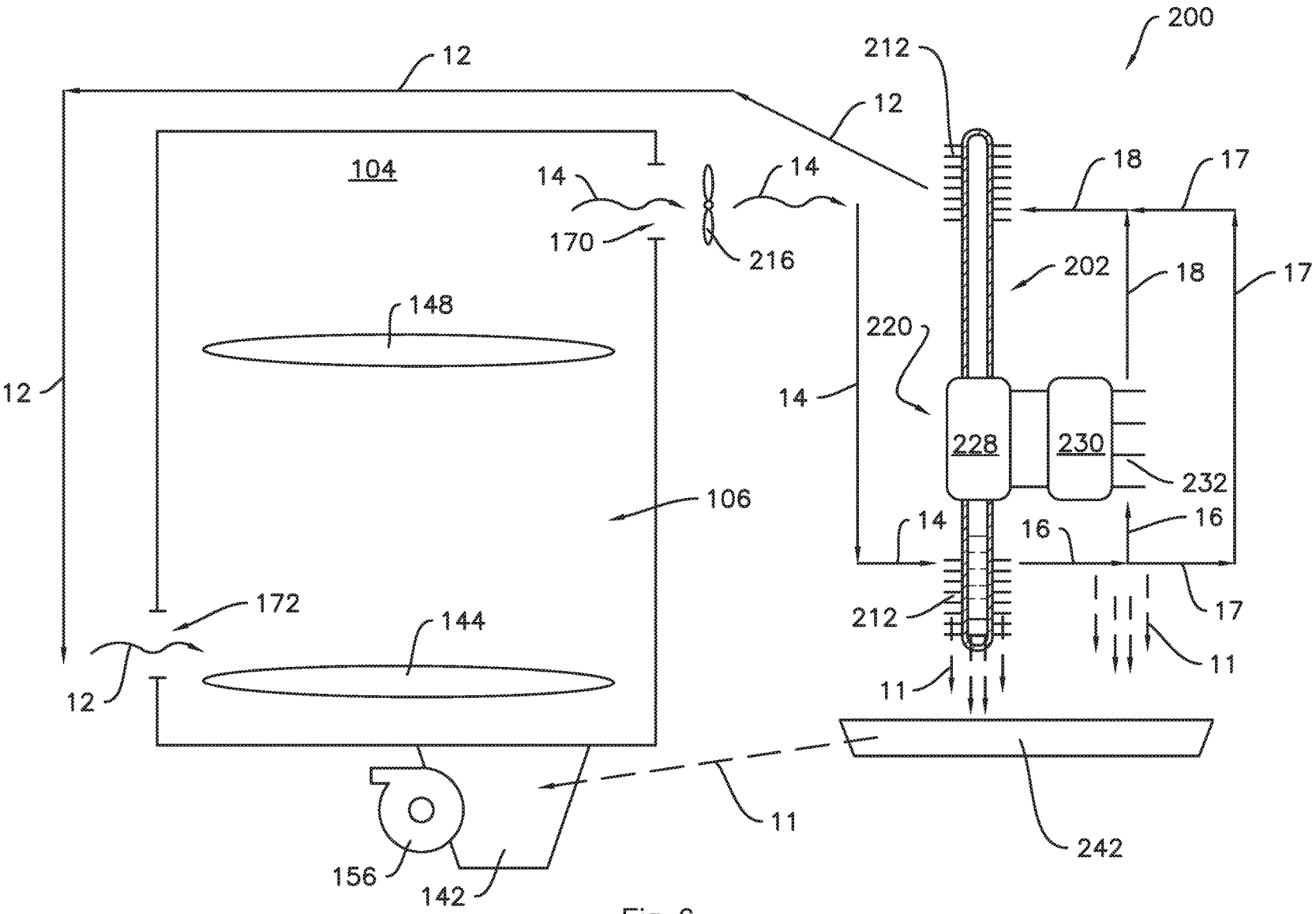
FIG. 6 illustrates a schematic view of a drying system for a dishwashing appliance according to one or more further additional embodiments of the present disclosure.
Figure 7:
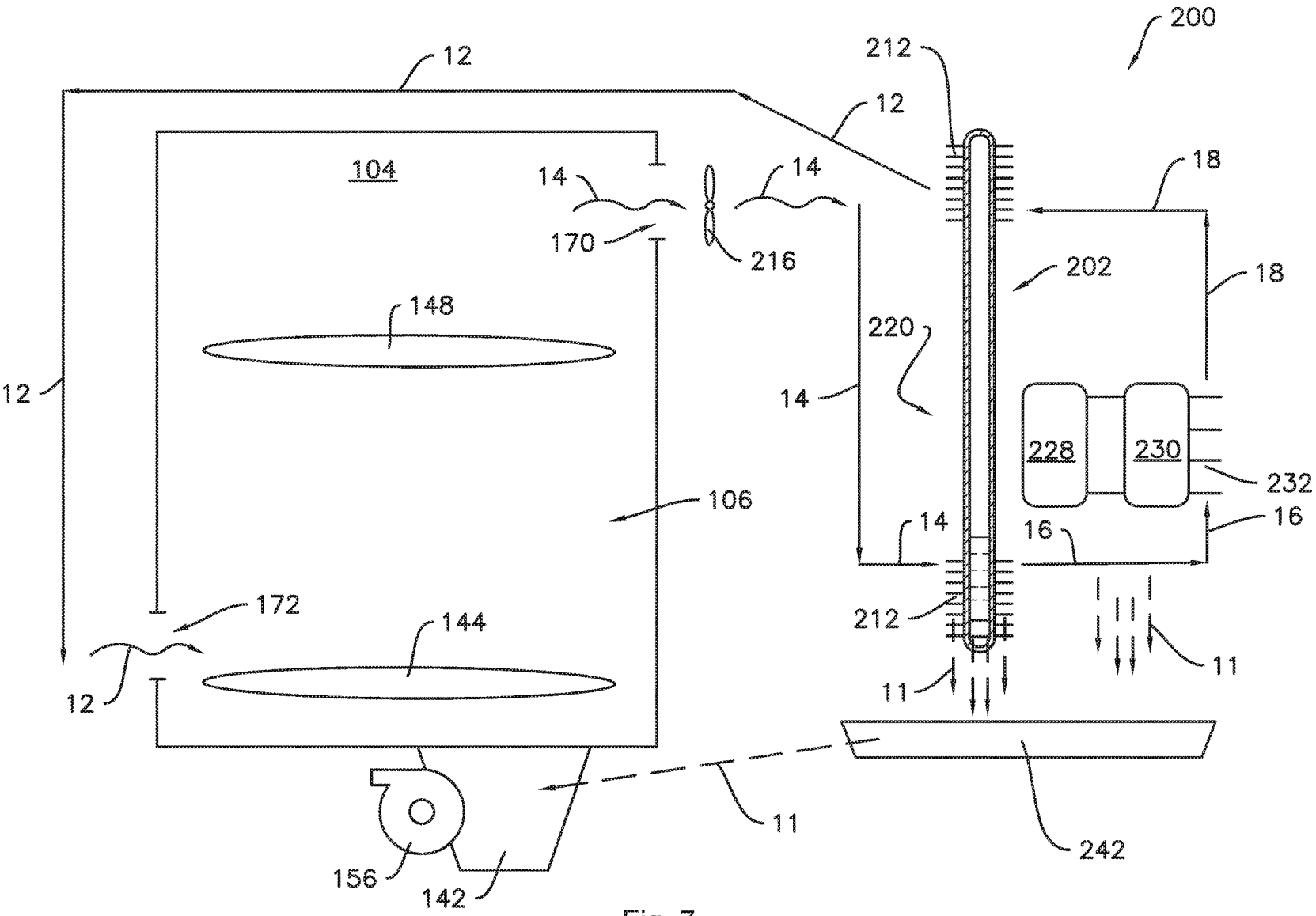
FIG. 7 illustrates a schematic view of a drying system for a dishwashing appliance according to one or more still further additional embodiments of the present disclosure.

In some embodiments, as shown in FIG. 6, a portion 17 of the warm humid air 16 from the evaporator section 210 may bypass the cold plate 230 of the thermoelectric assembly 220. For example, the drying system 200 may be configured to provide direct fluid communication from the evaporator section 210 of the heat pipe 202 to the cold plate 230 and to provide direct fluid communication from the evaporator section 210 to the condenser section 208. Thus, in some embodiments, the condenser section 208 may receive a flow of mixed air containing both ambient temperature humid air 18 and warm humid air 17.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwashing appliance, comprising:

a tub defining a wash chamber, the tub comprising an inlet and an outlet; and a drying system in fluid communication with the wash chamber, the drying system comprising:

a heat pipe heat exchanger comprising a condenser section and an evaporator section, the evaporator section downstream of the outlet, the condenser section downstream of the evaporator section and upstream of the inlet; and a thermoelectric assembly in thermal communication with the heat pipe heat exchanger, wherein the thermoelectric assembly comprises a thermoelectric converter having a hot side and a cold side, the cold side being located on an opposite face of the thermoelectric converter from the hot side, a hot plate connected to the hot side of the thermoelectric converter, and a cold plate connected to the cold side of the thermoelectric converter, wherein the hot side is configured to transfer thermal energy to the heat pipe via the hot plate, and wherein the thermoelectric converter is a single unitary piece.

2. The dishwashing appliance of claim 1, wherein the drying system is a closed loop drying system fluidly isolated from an ambient environment around the dishwashing appliance.

3. The dishwashing appliance of claim 1, wherein the drying system is an open loop drying system in fluid communication with an ambient environment around the dishwashing appliance.

4. The dishwashing appliance of claim 1, wherein the cold plate is in fluid communication with the heat pipe heat exchanger downstream of the evaporator section and upstream of the condenser section.

5. The dishwashing appliance of claim 1, wherein the thermoelectric assembly further comprises a plurality of fins on the cold plate.

6. The dishwashing appliance of claim 1, wherein the hot plate is directly connected to the heat pipe heat exchanger.

7. The dishwashing appliance of claim 1, wherein the hot plate is proximate to the heat pipe heat exchanger whereby the hot plate is in thermal communication with the heat pipe heat exchanger.

8. The dishwashing appliance of claim 1, further comprising a sump positioned at a bottom of the wash chamber for receiving fluid from the wash chamber and wherein the drying system is configured to drain condensation from the evaporator section of the heat pipe heat exchanger to the sump.

9. The dishwashing appliance of claim 1, wherein the dishwashing appliance defines a vertical direction, the condenser section of the heat pipe heat exchanger positioned above the evaporator section of the heat pipe heat exchanger along the vertical direction such that condensed working fluid flows within the heat pipe heat exchanger from the condenser section to the evaporator section by gravity and condensation flows from an exterior of the heat pipe heat exchanger by gravity.

10. The dishwashing appliance of claim 1, wherein the heat pipe heat exchanger comprises a first plurality of fins on an external surface of a casing at the condenser section and a second plurality of fins on the external surface of the casing at the evaporator section.

11. The dishwashing appliance of claim 1, wherein the drying system is configured to provide direct fluid communication from the evaporator section of the heat pipe heat exchanger to the thermoelectric assembly and to provide direct fluid communication from the evaporator section of the heat pipe heat exchanger to the condenser section of the heat pipe heat exchanger.

12. The dishwashing appliance of claim 1, wherein the thermoelectric converter further comprises at least one anode and at least one cathode configured to convert electrical energy to heat.

13. A drying system, comprising:

a heat pipe heat exchanger comprising a condenser section and an evaporator section, the heat pipe in fluid communication with a wet chamber defined within a tub, the evaporator section downstream of an outlet of the tub and the condenser section downstream of the evaporator section and upstream of an inlet of the tub; and a thermoelectric assembly in thermal communication with the heat pipe heat exchanger, wherein the thermoelectric assembly comprises a thermoelectric converter having a hot side and a cold side, a hot plate connected to the hot side of the thermoelectric converter, and a cold plate connected to the cold side of the thermoelectric converter, and wherein the thermoelectric converter further comprises at least one anode and at least one cathode configured to convert electrical energy to heat.

14. The drying system of claim 13, wherein the drying system is a closed loop drying system of a dishwashing appliance, the drying system being fluidly isolated from an ambient environment around the dishwashing appliance.

15. The drying system of claim 13, wherein the drying system is an open loop drying system of a dishwashing appliance, the drying system being in fluid communication with an ambient environment around the dishwashing appliance.

16. The drying system of claim 13, wherein the cold plate is in fluid communication with the heat pipe heat exchanger upstream of the condenser section and downstream of the evaporator section.

17. The drying system of claim 13, wherein the thermoelectric assembly further comprises a plurality of fins on the cold plate.

18. The drying system of claim 13, wherein the hot plate is directly connected to the heat pipe heat exchanger.

19. The drying system of claim 13, wherein the hot plate is proximate to the heat pipe heat exchanger.

20. The drying system of claim 13, wherein the thermoelectric converter is a single unitary piece.

* * * * *